US006661172B2

(12) United States Patent
Kuti et al.

(10) Patent No.: US 6,661,172 B2
(45) Date of Patent: Dec. 9, 2003

(54) ELECTRODE ASSEMBLY AND LAMP WITH CONDUCTOR FOIL

(75) Inventors: Ernö Kuti, Budapest (HU); Miklós Valovics, Piliscsaba (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,511

(22) Filed: Jan. 11, 2002

(65) Prior Publication Data

US 2003/0132708 A1 Jul. 17, 2003

(51) Int. Cl.[7] ..... H01J 17/18
(52) U.S. Cl. ..... 313/624; 313/623
(58) Field of Search ..... 313/623, 624, 313/625, 626

(56) References Cited

U.S. PATENT DOCUMENTS

| | | | | |
|---|---|---|---|---|
| 2,786,882 A | | 3/1957 | Krefft | |
| 2,966,607 A | | 12/1960 | Thouret | |
| 3,515,931 A | | 6/1970 | Takakuwa | 313/318 |
| 4,254,356 A | | 3/1981 | Karikas | 313/217 |
| 4,295,185 A | | 10/1981 | Martin | |
| 5,138,227 A | | 8/1992 | Heider et al. | 313/623 |
| 5,200,669 A | | 4/1993 | Dixon et al. | 313/623 |
| 5,430,353 A | * | 7/1995 | Feldman et al. | 313/623 |

FOREIGN PATENT DOCUMENTS

| | | | |
|---|---|---|---|
| EP | 0635866 A1 | 1/1995 | H01J/61/36 |
| EP | 1067581 A2 | 1/2001 | H01J/61/36 |
| EP | 1289001 A2 | 3/2003 | H01J/61/36 |

OTHER PUBLICATIONS

European Search Report, May 9, 2003; Application No. EP 03 25 0137; Application General Electric Company; Search date Apr. 28, 2003, Munich.

* cited by examiner

*Primary Examiner*—Vip Patel
(74) *Attorney, Agent, or Firm*—Fay, Sharpe, Fagan, Minnich & McKee, LLP

(57) ABSTRACT

This invention relates to an electrode assembly for a sealed lamp envelope. The electrode assembly comprises an outer lead wire and an inner lead wire, providing electric connection to an electrode in the envelope. A substantially planar conductor foil connects the outer lead wire and the inner lead wire. The conductor foil provides a sealed electric connection through a sealed portion of the envelope. In order to improve the mechanical stiffness of the conductor foil, the conductor foil comprises a curvature. The curvature is formed by the foil in a plane substantially perpendicular to a line connecting the outer lead wire and the inner lead wire. There is provided a lamp with the electrode assembly and a method for stiffening a conductor foil of an electrode assembly of a sealed lamp envelope.

18 Claims, 4 Drawing Sheets

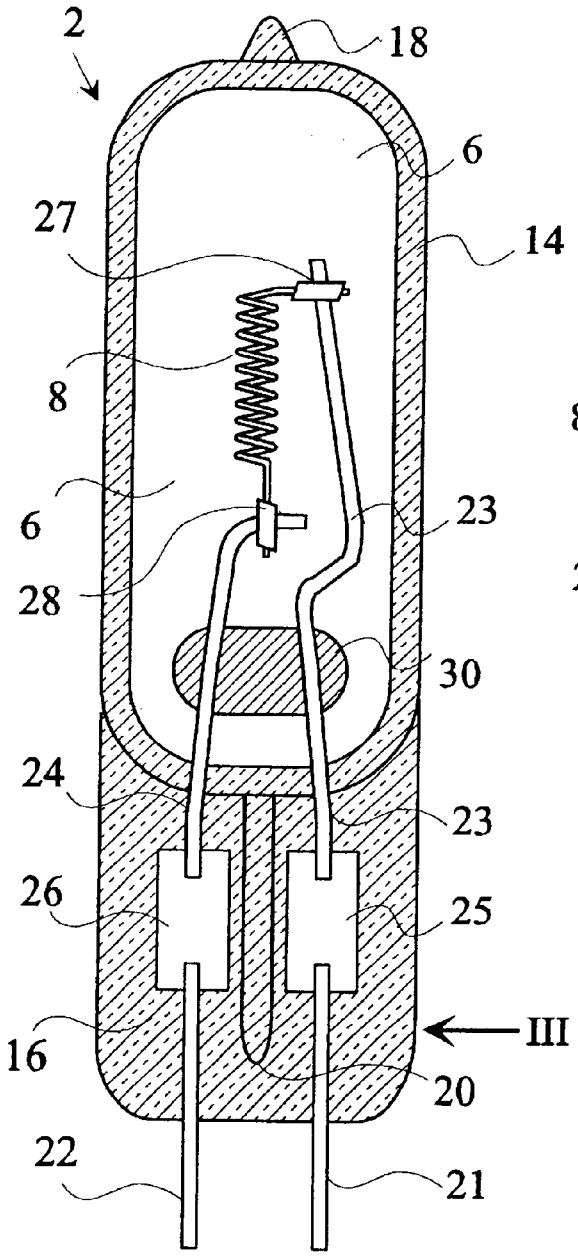
Fig. 2
Fig. 3
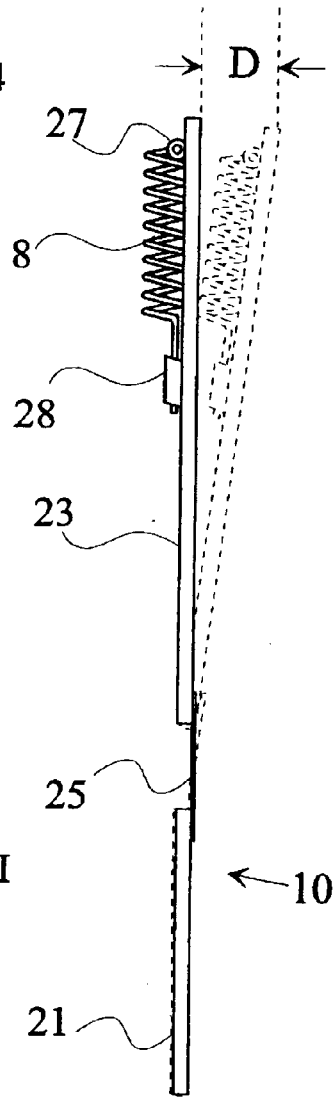

Fig. 6
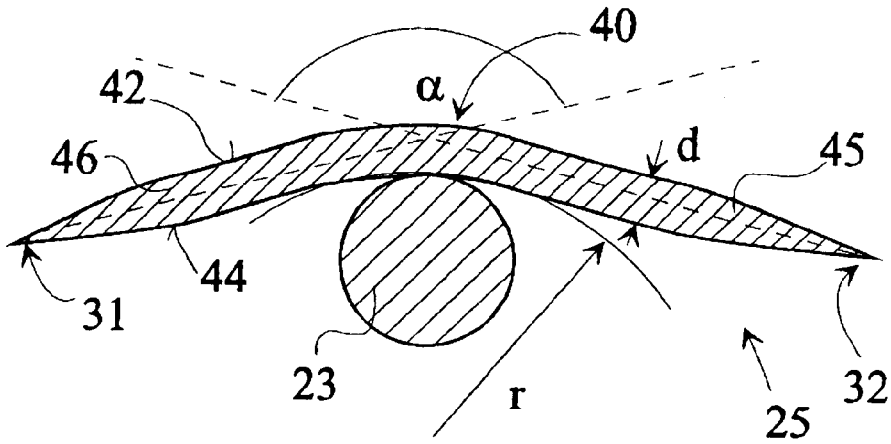
Fig. 7
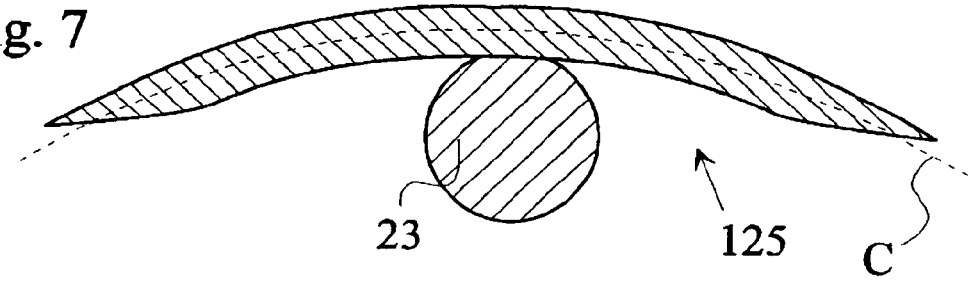
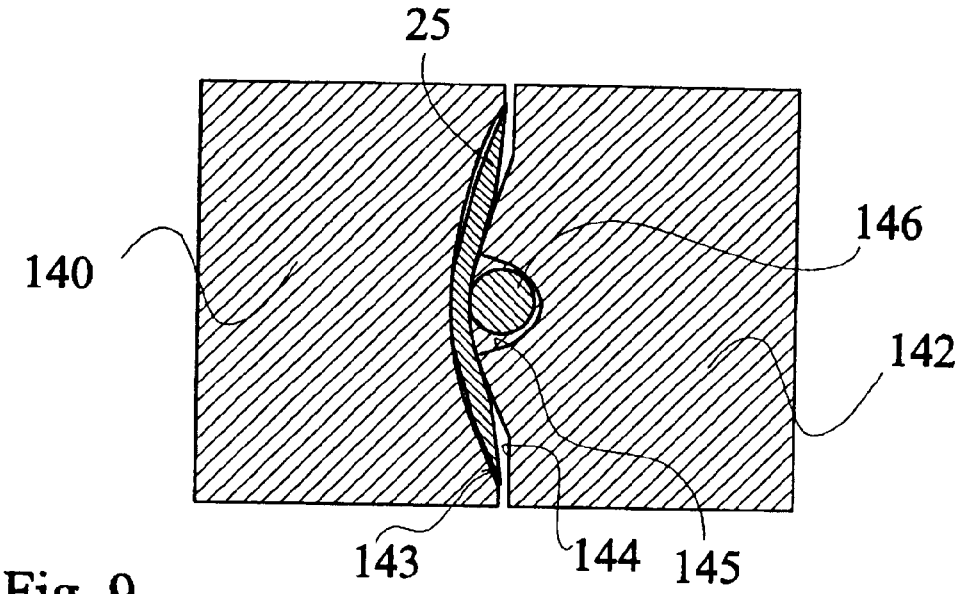
Fig. 9

ELECTRODE ASSEMBLY AND LAMP WITH CONDUCTOR FOIL

BACKGROUND OF INVENTION

This invention relates to an electrode assembly. The electrode assembly comprises a substantially planar conductor foil which provides a sealed electric connection through a sealed portion of a lamp envelope. The invention further relates to a method for stiffening a conductor foil of an electrode assembly of a sealed lamp envelope.

A wide variety of lamps with sealed, typically glass or quartz envelopes are known in the art. The envelope contains the electric fittings necessary for the specific physical process which generates the light. A typical example is an incandescent lamp where the sealed envelope contains a glow filament which is heated by electric current flowing through the filament. The current is lead into the envelope by lead wires. Beside the electric fitting, the envelope often also contains a special gas, for example halogen gas such as argon or xenon. A common problem for such lamps is the gas-tight sealing of the glass or quartz around the lead wires, and the exact positioning of the electrode assembly within the sealed envelope. In production, the envelope of the lamp is made from a glass or quartz tube. The lead wires are introduced into the envelope through an open end of the tube, and the end of the tube is pinch sealed, while the material of the tube at the end portion is heated above softening temperature. The sealing of the tube end is done by two pinch jaws which press the softened tube end flat, enclosing the lead-in wires.

It is known that good sealing around the lead-in wires by themselves is practically not achievable. Therefore, it is also known to employ a thin conductor foil in the sealed portion of the envelope. These conductor foils are acting as the sealed lead-through conductors, and the outer and inner lead wires are connected to the conductor foils. The material of the foil is mostly molybdenum. Due to the low thickness of the foil, the softened glass can completely flow around the foil during the pinching, and good, long-term sealing of the envelope is achieved.

However, this sealing technique also poses certain problems for the exact positioning of the electrode assembly. Ideally, the foil should be infinitely thin in order to avoid the stresses caused by the differences in the thermal expansion coefficients of the foil and the glass. In practice, the foils are made very thin, in the order of 20–30 microns. During manufacturing of the lamp, the foils must mechanically support and hold stable the inner lead wires and the attached components, e.g. a glass bead connecting the inner lead wires and the filament welded to the inner lead wires. The low thickness of the foils results in a very easy bending the foil, for example when the electrode assembly is transported on a conveyor line. The chances of an undesired bending of the foil are particularly high during the pinching operation. Such bending results in an offset of the inner lead wires relative to the desired position. Excessive offset of the lead wires or other parts of the electrode assembly may cause early failure of the lamp, or a decrease of the yield, if the offset can not be compensated by a re-positioning of the complete envelope relative to the lamp housing.

In a known method, a protrusion is formed on the pinching jaw that supports from the side the inner lead wire within the indented glass. This solution very much depends on the accurate setting of the pinching jaw, and the natural wear of the jaws must be continuously readjusted. Further, as a result of the protrusion pressing into the glass, the wall thickness of the glass decreases at the indented glass segment which must bear the internal pressure. Also, indentations and protrusions are formed in the glass wall as well. These indentations and protrusions are potential stress sources which may cause cracks in the glass. This may even lead to an explosion of the lamp.

An incandescent lamp with a sealing conductor foil, also termed as a conductor ribbon is disclosed in U.S. Pat. No. 4,295,185. The lamp has a sealed envelope surrounding an electrode assembly. The electrode assembly has outer and inner lead wires which are connected to each other with the conductor ribbon. Tubes are attached to the inner lead wires for receiving the ends of a filament. In order to improve the positioning accuracy of the inner lead wires, and thereby that of the filament, the inner lead wires are connected to each other with an insulating body. However, this means that the conductor ribbons must bear an even greater mass during the assembly of the lamp. No provisions are made to improve the mechanical strength of the conductor ribbons.

Therefore, there is a need for an electrode assembly having conductor foils with an improved mechanical strength, but without impairing the sealing properties of the lead-through conductor foil. Also, there is a need for an electrode assembly for a sealed lamp envelope which would not require complicated manufacturing facilities, but would need only a few additional production steps at most, which could be integrated into the existing production lines in a simple manner.

SUMMARY OF INVENTION

In an embodiment of the present invention, there is provided an electrode assembly for a sealed lamp envelope. The electrode assembly comprises an outer lead wire for providing an external electric connection terminating outside of the envelope. An inner lead wire of the electrode assembly provides mechanical support and electric connection to an electrode in the envelope. A conductor foil connects the outer lead wire and the inner lead wire. The conductor foil provides a sealed electric connection through a sealed portion of the envelope. In order to improve the mechanical stiffness of the conductor foil, it comprises a curvature. The curvature is formed by the foil in a plane substantially perpendicular to a line connecting the outer lead wire and the inner lead wire. It is most expedient when the curvature is constituted by an edge of a fold. This edge is formed substantially parallel to a common central axis of the outer and inner lead wires.

According to another embodiment of the invention, there is provided a method for stiffening a conductor foil of an electrode assembly of a sealed lamp envelope, where the assembly comprises an outer lead wire for providing an external electric connection terminating outside of the envelope, and an inner lead wire for providing mechanical support and electric connection to electrodes in the envelope, and a substantially planar conductor foil connects the outer lead wire and the inner lead wire. The method comprises the step of providing a curvature in the conductor foil in a plane substantially perpendicular to a line connecting the outer lead wire and the inner lead wire.

The electrode assembly has a higher mechanical stiffness compared with assemblies having flat conductor foils. The suggested electrode assembly improves the positioning accuracy of the electrodes, and lamps with such electrode assemblies have lower fault rates. The improved mechanical stiffness of the foil requires only one additional manufacturing step, so that lamps with such electrode assemblies may be manufactured at practically same cost.

BRIEF DESCRIPTION OF DRAWINGS

FIG. 2 is an enlarged side view of the sealed envelope of the lamp shown in FIG. 1, with an embedded electrode assembly.

FIG. 3 is another side view of the electrode assembly of FIG. 2, from the direction of the arrow 111 in FIG. 2.

FIG. 6 is a cross-section of a conductor foil shown in FIG. 5, taken along the plane VI—VI of FIG. 5.

FIG. 7 is a cross-section of another conductor foil, shown in a similar view as FIG. 6.

FIG. 9 is a cross section of a folding tool and a conductor foil, showing the folding step of the method, in a cross section similar to that of FIG. 6.

DETAILED DESCRIPTION

Figure 1:
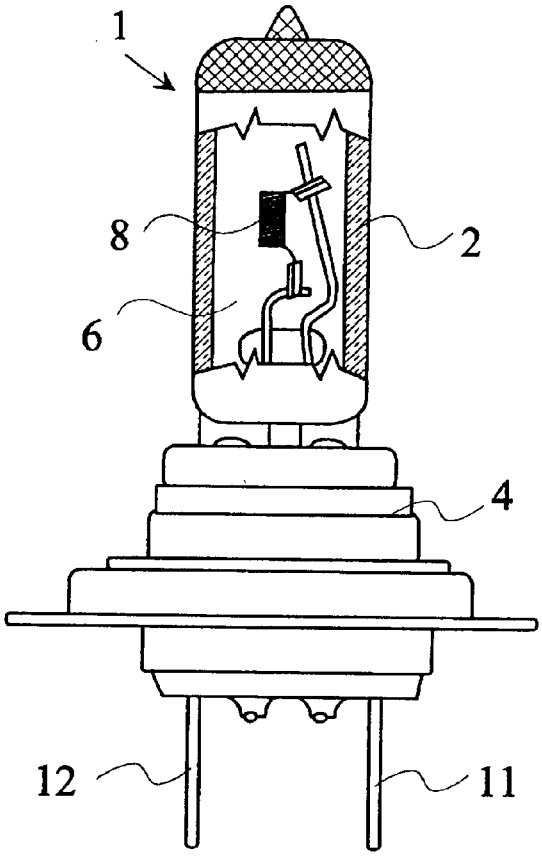
FIG. 1 is a side view of a lamp with a sealed glass envelope.

Referring now to FIGS. 1 to 3, there is shown an automotive lamp 1. The lamp 1 has a sealed lamp envelope 2, typically made of glass. The envelope 2 is supported mechanically by a metal base 4 which also holds the contacts 11, 12 of the lamp 1. The envelope 2 has a sealed inner volume 6 filled with a suitable gas, like argon, krypton or xenon. The inner volume 6 also contains a filament 8 which is a part of an electrode assembly 10, the latter shown separately in FIG. 3. As best seen in FIG. 2, the envelope 2 has a chamber part 14 containing the inner volume 6 of the lamp and a sealed part 16. During production of the envelope 2, the sealed part 16 is created by pressing together an end of a glass tube, while the chamber part 14 is formed by the central part of the glass tube. The other end of the glass tube terminates in an exhaust tube, which is later removed, leaving only a small remaining tip 18 on top of the chamber part 14. A narrow rib 20 is formed on the sealing part 16 during the pinching of the sealing part. This rib 20 adds mechanical strength to the relatively thin sealing part 16.

The envelope 2 comprises outer lead wires 21, 22 partly embedded in the sealing part 16. The outer lead wires 21, 22 terminate outside of the envelope 2, and in this manner they provide the external electric connection of the electrode assembly 10. Two inner lead wires 23, 24 provide mechanical support and electric connection to an electrode in the envelope. In the embodiment shown in FIG. 2, the electrode is a filament 8. The filament 8 is welded to the inner lead wires 23, 24 with small tubes 27,28. For improved stability of the electrode assembly 10, the inner lead wires 23, 24 are fastened to each other with an insulating body, commonly realized as a glass bead 30. It is noted that for smaller lamps, the inner lead wires are often integral with the filament, i.e. the ends of the filament function directly as the inner lead wires.

The outer lead wires 21, 22 and the inner lead wires 23, 24 are connected to each other by substantially planar conductor foils 25, 26. These conductor foils 25, 26 provide the sealed electric connection through the sealed portion 16 of the envelope 2. As best seen in FIGS. 6 and 7, the lateral edges 31, 32 of the foils 25, 26 end in an acute angle in order to facilitate the complete closure of the molten glass around the edges 31, 32 during the pinching of the sealing part 16. Typically, the foils 25, 26 are made of molybdenum, and their thickness d is between 20–30 $\mu$m, for example 25 $\mu$m.

Figure 4:
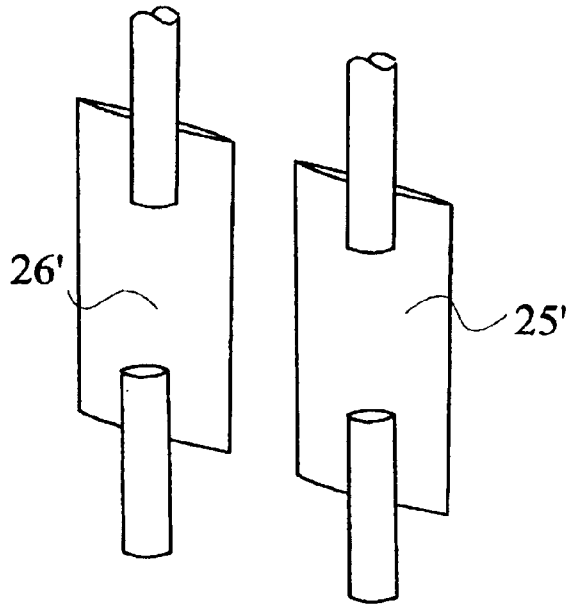
Fig. 4 PRIOR ART
FIG. 4 is a perspective view of a pair of prior art conductor foils, connecting a pair of inner and outer lead wires, respectively.
Figure 5:
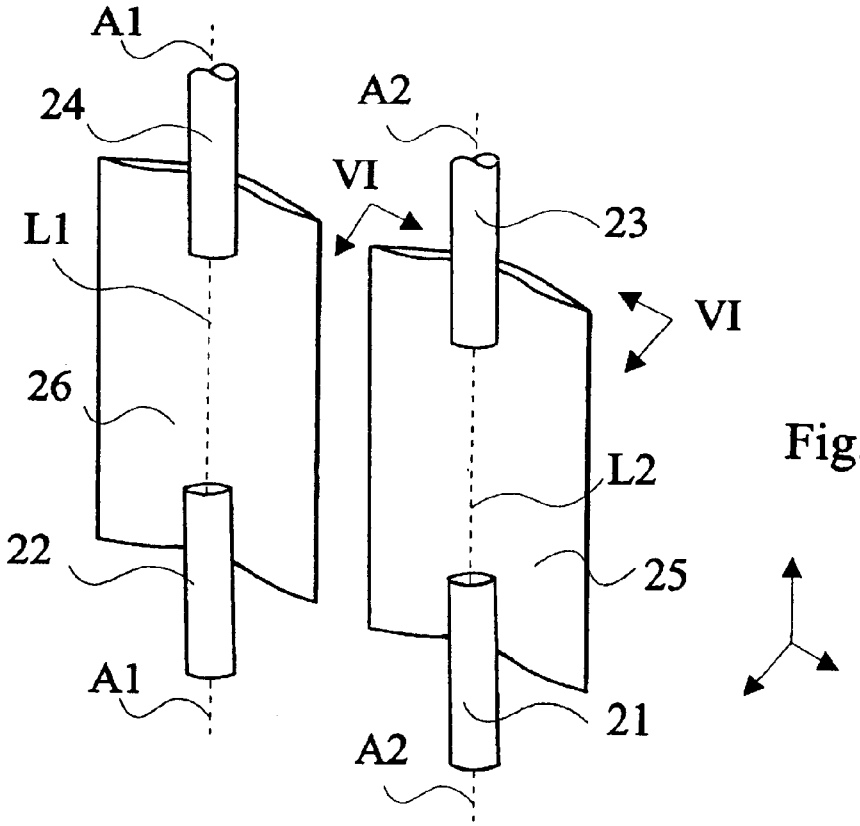
FIG. 5 is a perspective enlarged view of the pair of conductor foils of FIG. 2, connecting a pair of inner and outer lead wires, respectively, and comprising a curvature.

In order to improve the mechanical stability of the electrode assembly 10, the conductor foils 25, 26 comprise a curvature in a plane substantially perpendicular to the lines L1 and L2, which connect the outer lead wires 21, 22 and the inner lead wires 23, 24 respectively. With other words, the foils 25, 26 are curved when seen in a cross-section in this plane. This is best perceived by comparing FIGS. 4 and 5, where FIG. 4 illustrates a pair of prior art foils 25", 26", being substantially straight in perpendicular cross-section, while the foils 25, 26 shown in FIG. 5 are visibly curved. The curvature is also clearly seen in FIG. 6, showing the foil 25 in a cross-section in plane VI—VI of FIG. 5.

The curved conductor foils 25, 26 have a significantly increased stiffness, as compared with straight foils. Without the curvature, the foils 25, 26 have a high tendency to bend, and thereby to allow a swaying of the inner lead wires 23, 24 and the attached filament 8, as illustrated in FIG. 3 with dotted lines. Even a small bending of the foils 25, 26 may cause a relatively large displacement D of the filament 8. In certain applications, like automotive lamps, this displacement or deflection D is one of the key parameters, and it must be kept as low as possible. With a series of standard automotive lamps, the proposed curved foils resulted in the decrease of the average displacement D from a value of 0.17 mm to a value of 0.10 mm, while the maximum deflection value also decreased from 0.32 mm to 0.20 mm. With other words, the suggested foil arrangement produced a 40% reduction in the average deflection.

The curvature may be constituted by an edge 40 of a fold, where the 40 edge is substantially parallel to a common central axis A1, A2 of the outer lead wires 21, 22 and inner lead wires 23, 24. This edge 40 is a blunt edge, so that an inner radius of curvature r of the foil 25 at the folded edge 40 is not less than 0.2 mm, preferably not less than 0.5 mm. In this manner, both the inner surface 44 and the outer surface 42 of the foil 25 may be covered completely by the molten glass of the sealed part 16 during pinching. This is also facilitated by the fact that the included angle $\alpha$ between the wings 45, 46 of the fold in a plane perpendicular to the edge 40 is not less than 150 degrees, but preferably less than 170 degrees.

The curvature of the foils 25, 26 need not be restricted to a relatively narrow region of the foils 25, 26. FIG. 7 illustrates another embodiment of the conductor foils, where the curvature extends to the substantially whole width of the foil 125. For example, the foil 125 shown in FIG. 7 is formed as a portion of a cylinder, so that the foil 125 has a sickle-like or crescent-like cross section in a plane perpendicular to a line connecting the inner and outer lead wires. This is also indicated by the arched center line C of the foil 125.

Figure 8:
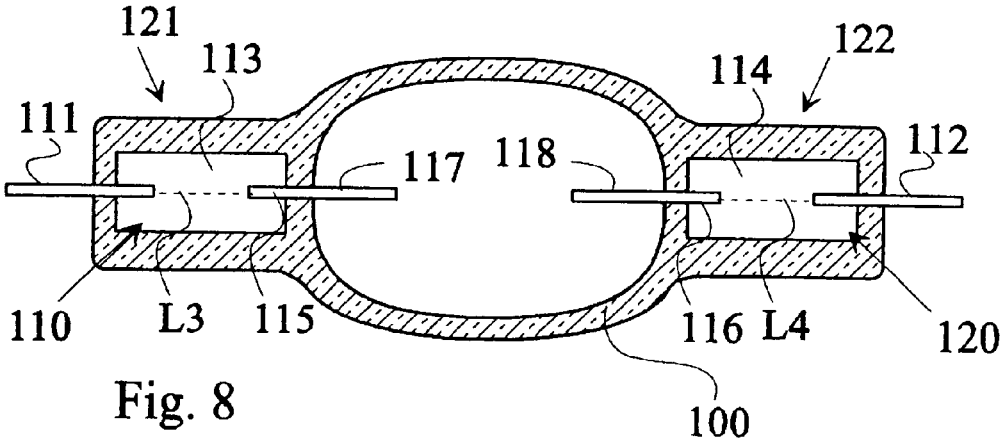
FIG. 8 is a cross-section of another lamp with a sealed envelope and conductor foils.

The electrode assembly may be used with all types of lamps where conductor foils are used as the sealed electrical connection into a sealed envelope. FIGS. 1 and 2 illustrate an embodiment where the lamp is an incandescent lamp, and the electrode assembly comprises a glow filament. However, other types of lamps may also benefit from the suggested electrode assembly. FIG. 8 shows a discharge chamber 100 of an arc discharge lamp with two identical electrode assemblies 170 and 120 at the two ends 127, 122 of the discharge chamber 100. The electrode assembly 110 comprises an outer lead wire 111 for providing an external electric connection terminating outside of the discharge chamber 100, and an inner lead wire 115. The electrode assembly 110 also comprise arc discharge electrode 111. In the embodiment shown in FIG. 8, the arc discharge electrode 117 is integral with the inner lead wire 115, in practice the inner lead wire 115 is constituted by the arc discharge electrode 117. However, with different embodiments (not shown) the arc discharge electrode may be a separate entity which is directly or indirectly attached to the inner lead wire.

Similarly to the electrode assembly 110, the other electrode assembly 120 comprises the outer lead wire 112 and the inner lead wire 116 which latter also functions as the arc discharge electrode 118.

The electrode assemblies 110, 120 of the discharge chamber 100 also has substantially planar conductor foils 113, 114 connecting the outer lead wires 111, 112 and the inner lead wires 115, 116. As in the embodiments shown in FIG. 5, the conductor foils 113, 114 are curved in a plane substantially perpendicular to the lines L3, L4 connecting the outer lead wires 111, 112 and the inner lead wires 115, 116, respectively.

As it is apparent from the above, there is provided a method for stiffening a conductor foil of an electrode assembly of a sealed lamp envelope, where the electrode assembly has outer lead wires and an inner lead wires connected by a conductor foil. The method comprises the step of providing a curvature in the conductor foil in a plane substantially perpendicular to a line connecting the outer lead wire and the inner lead wire. Preferably, the curvature is made by folding an edge in the foil, so that the folded edge is substantially parallel to a common central axis of the outer and inner lead wires.

The conductor foils are typically rectangular, with a small size, e.g. they may have a width of 3 mm and a height of 6–8 mm. The foils are rectangular, and they are normally cut from a continuous ribbon material during the manufacturing of the electrode assembly. In most practical lamp applications, the inner and outer lead wires are welded to the foil. In a possible embodiment of the method, the foils are folded after the welding of the foils to the lead wires. In this manner, the foils themselves are already fastened through the lead wires, typically through the outer lead wires, to some support device in a well-defined position. In this position, the folding of the foils may be performed by a suitably formed tool pair, like the pinch jaws 140 and 142 shown in FIG. 9. The pinch jaws 140 and 142 have forming surfaces 143 and 144 with an appropriate indentation 145 for receiving a lead wire end 146. The pinch jaws 140, 142 may be operated with a suitable actuator system, e.g. a pneumatic piston system.

Alternatively, the folding of the foils may also be performed with the suitably formed electrodes of the welding apparatus that is used to weld the inner and outer lead wires to the foil. In this case, the foil may be folded during the welding of the lead wires, or even before the actual welding takes place. However, the wear of the welding electrodes makes this option less practical.

Experiments demonstrated that the sealing properties of the curved conductor foils are unchanged. Explosion test were also performed to verify that the explosion strength of the sealed envelope did not deteriorate. The stiffer conductor foils resulted in less misalignment between the electrode assembly and the pinch jaws, and the quality of the seal around the foils improved, both in terms of uniformity and benchmark values. The so-called channel-type leaky pinching was largely eliminated.

The invention is not limited to the shown and disclosed embodiments, but other elements, improvements and variations are also within the scope of the invention. It is clear for those skilled in the art that the same principle may be applied to the conductor foils of a wide variety of lamps. For example, the proposed lamp and electrode assembly is applicable not only with automotive incandescent lamps (halogen lamps), but also with other types of lamps, e.g. gas discharge lamps, arc discharge lamps or mercury vapor lamps.

What is claimed is:

1. An electrode assembly for a sealed lamp envelope, comprising an outer lead wire for providing an electric connection terminating outside of the envelope, and an inner lead wire for providing mechanical support and electric connection to an electrode in the envelope, and a conductor foil connecting the outer lead wire and the inner lead wire, the conductor foil providing a sealed electric connection through a sealed portion of the envelope, the conductor foil comprising a single curvature in a plane substantially perpendicular to a line connecting the outer lead wire and the inner lead wire.

2. The assembly of claim 1 in which the foil has a sickle-like or crescent-like cross section in a plane perpendicular to a line connecting the inner and outer lead wires.

3. The assembly of claim 1 in which the lateral edges of the foil end in an acute angle.

4. The assembly of claim 1 in which the foil is made of molybdenum.

5. The assembly of claim 1, in which the thickness of the foil is 20–30 $\mu$m.

6. An electrode assembly for a sealed lamp envelope comprising:

an outer lead wire for providing an electric connection terminating outside of the envelope;

an inner lead wire for providing mechanical support and electric connection to an electrode in the envelope; and a conductor foil connecting the outer lead wire and the inner lead wire, the conductor foil providing a sealed electric connection through a sealed portion of the envelope, the conductor foil comprising a curvature that is constituted by an edge of a fold, the edge being substantially parallel to a common central axis of the outer and inner lead wires.

7. The assembly of claim 6 in which the included angle between the wings of the fold in a plane perpendicular to the edge is not less than 150 degrees, and less than 170 degrees.

8. The assembly of claim 6 which an inner radius of curvature of the foil at the folded edge is not less than 0.2 mm.

9. The assembly of claim 6 in which the foil has a sickle-like or crescent-like cross section in a plane perpendicular to a line connecting the inner and outer lead wires.

10. The assembly of claim 6 in which the lateral edges of the foil end in an acute angle.

11. The assembly of claim 6 which the foil is made of molybdenum.

12. The assembly of claim 6, in which the thickness of the foil is 20–30 $\mu$m.

13. A lamp comprising a sealed envelope and an electrode assembly, the electrode assembly comprising an outer lead wire for providing an external electric connection terminating outside of the envelope, and an inner lead wire for providing mechanical support and electric connection to electrodes in the envelope, and a conductor foil connecting the outer lead wire and the inner lead wire, the conductor foil providing a sealed electric connection through a sealed portion of the envelope, the conductor foil comprising a single curvature in a plane substantially perpendicular to a line connecting the outer lead wire and the inner lead wire.

14. The lamp of claim 13 which the lamp is an incandescent lamp, and the electrode assembly comprises a glow filament.

15. The lamp of claim 13 which the lamp is a discharge lamp, and the electrode assembly comprises a discharge electrode.

16. The lamp of claim 15 in which the discharge electrode is directly or indirectly attached to the inner lead wire.

17. The lamp of claim 6 in which the inner lead wire terminates in the arc discharge electrode.

18. The lamp of claim 13, wherein the curvature is constituted by an edge of a fold, the edge being substantially parallel to a common central axis of the outer and inner lead wires.

* * * * *

UNITED STATES PATENT AND TRADEMARK OFFICE

CERTIFICATE OF CORRECTION

PATENT NO. : 6,661,172 B2
DATED : December 9, 2003
INVENTOR(S) : Erno Kuti et al.

It is certified that error appears in the above-identified patent and that said Letters Patent is hereby corrected as shown below:

Column 8,
Lines 22-23, should read
17. The lamp of claim 15 in which the inner lead wire terminates in the arc discharge electrode.

Signed and Sealed this

Twenty-third Day of March, 2004

JON W. DUDAS
*Acting Director of the United States Patent and Trademark Office*